US009869280B2

(12) United States Patent
Maxim

(10) Patent No.: US 9,869,280 B2
(45) Date of Patent: Jan. 16, 2018

(54) MIXER VALVE OF AN INTERNAL COMBUSTION ENGINE OF A MOTOR VEHICLE

(71) Applicant: CONTINENTAL AUTOMOTIVE GMBH, Hannover (DE)

(72) Inventor: Daniel Iosif Maxim, Timisoara (RO)

(73) Assignee: Continental Automotive GmbH, Hannover (DE)

( * ) Notice: Subject to any disclaimer, the term of this patent is extended or adjusted under 35 U.S.C. 154(b) by 221 days.

(21) Appl. No.: 14/395,382

(22) PCT Filed: Apr. 11, 2013

(86) PCT No.: PCT/EP2013/057537
§ 371 (c)(1),
(2) Date: Oct. 17, 2014

(87) PCT Pub. No.: WO2013/156373
PCT Pub. Date: Oct. 24, 2013

(65) Prior Publication Data

US 2015/0059717 A1 Mar. 5, 2015

(30) Foreign Application Priority Data

Apr. 18, 2012 (EP) ..... 12464005

(51) Int. Cl.
*F02B 47/08* (2006.01)
*F02M 25/07* (2006.01)
(Continued)

(52) U.S. Cl.
CPC ..... *F02M 25/0798* (2013.01); *F02D 9/1065* (2013.01); *F02M 26/21* (2016.02);
(Continued)

(58) Field of Classification Search
CPC ..... F02D 41/0077; F02M 25/0798; F02M 25/0786; F02M 25/0707; F02M 25/074; F02M 25/0701; F02M 26/21; F02M 26/51; F02M 26/53; F02M 26/64; F02M 26/70; F02M 26/54; F02M 26/71; F02M 26/69
(Continued)

(56) References Cited

U.S. PATENT DOCUMENTS 8,561,645 B2 10/2013 Leroux et al.
8,862,369 B2 * 10/2014 Vitiello ..... F02D 11/10 123/568.12
(Continued)

FOREIGN PATENT DOCUMENTS

FR 2 926 114 A1 7/2009
FR 2 954 407 A1 6/2011
FR 2 954 408 A1 6/2011

OTHER PUBLICATIONS

Office Action dated Feb. 3, 2016 which issued in the corresponding Chinese Patent Application No. 2013800199818.

*Primary Examiner* — Syed O Hasan
(74) *Attorney, Agent, or Firm* — Cozen O'Connor

(57) ABSTRACT

A mixer valve of an internal combustion engine of a motor vehicle has a drive device with a respective drive pinion and a control disc for driving two flaps. A single servomotor for driving the drive pinion is arranged in a corner region of an exhaust gas duct and of an intake duct.

6 Claims, 4 Drawing Sheets

(51) Int. Cl.

| | |
|---|---|
| ***F02D 9/10*** | (2006.01) |
| ***F02M 26/21*** | (2016.01) |
| ***F02M 26/53*** | (2016.01) |
| ***F02M 26/64*** | (2016.01) |
| ***F02M 26/70*** | (2016.01) |
| ***F02M 26/51*** | (2016.01) |
| *F02D 9/02* | (2006.01) |
| *F02D 41/00* | (2006.01) |
| *F02M 26/54* | (2016.01) |

(52) U.S. Cl.
CPC ..... *F02M 26/51* (2016.02); *F02M 26/53* (2016.02); *F02M 26/64* (2016.02); *F02M 26/70* (2016.02); *F02D 41/0077* (2013.01); *F02D 2009/0276* (2013.01); *F02D 2041/0017* (2013.01); *F02M 26/54* (2016.02)

(58) Field of Classification Search
USPC ..... 123/568.11–568.32; 251/248, 279
See application file for complete search history.

(56) References Cited

U.S. PATENT DOCUMENTS

| | | | | |
|---|---|---|---|---|
| 9,145,854 | B2 * | 9/2015 | Hodebourg | F02D 41/0077 |
| 2012/0056118 | A1 * | 3/2012 | Yokoyama | F16K 1/223 251/248 |
| 2013/0000615 | A1 | 1/2013 | Hodebourg et al. | |

* cited by examiner

MIXER VALVE OF AN INTERNAL COMBUSTION ENGINE OF A MOTOR VEHICLE

CROSS-REFERENCE TO RELATED APPLICATIONS

This is a U.S. national stage of application No. PCT/EP2013/057537, filed on 11 Apr. 2013, which claims priority to the European Application No. EP 12464005 filed 18 Apr. 2012, the content of both incorporated herein by reference.

BACKGROUND OF THE INVENTION

1. Field of the Invention

The invention relates to a mixer valve of an internal combustion engine of a motor vehicle, having a flap arranged in an intake duct and having a flap arranged in an exhaust duct, having rotatable shafts which hold the flaps, wherein the intake duct and the exhaust duct issue into a common manifold duct, and having a drive device for driving the flaps.

Mixer valves of this type are commonly used in exhaust-gas recirculation systems of internal combustion engines of modern motor vehicles and are known from practice. The movements of the flap of the intake duct and of the flap of the exhaust duct are controlled such that the flap of the exhaust duct, proceeding from a first position, opens linearly with an actuation signal of the drive device. The flap of the intake duct however initially pauses in the first position and is closed only when an actuation signal provided exceeds a predefinable value. During the closing movement of the flap of the intake duct, the flap of the exhaust duct remains in the open position.

In modern motor vehicles, however, there is a demand for the mixer valve to take up a particularly small amount of space.

SUMMARY OF THE INVENTION

It is therefore an object of the present invention to solve the problem of designing a mixer valve of the type mentioned above such that it takes up a particularly small amount of space.

This problem may be solved, according to an aspect of the invention, in that the drive device has control disks arranged rotationally conjointly on the shafts of the flaps and has drive pinions mounted rotatably, and driven, on the shafts of the flaps, and in that the control disks and the drive pinions have drivers that correspond with one another.

By this configuration, it is possible for the flaps to be arranged particularly close together. The position of the drivers defines the manner in which the flaps are actuated in a manner dependent on the movement of the drive pinions. Since the drivers of the control disks and of the drive pinions can be positioned freely, it is possible to generate virtually any desired movement profiles with a single drive. In this way, the space taken up by the mixer valve according to the invention is kept particularly small. The control disks and the drive pinions are preferably arranged one above the other in sandwich-like fashion, which contributes to the compact construction of the mixer valve.

In another advantageous refinement of the invention, the pivoting movement of the flaps can be restricted in a simple manner if a housing that serves for the mounting of the shafts has stops for supporting the drivers arranged on the control disks.

In another advantageous refinement of the invention, the outlay in terms of construction for the drive of the drive pinions can be kept particularly low if the two drive pinions mesh with a common intermediate gearwheel. By this configuration, the two drive pinions are coupled to one another. A single servomotor is thus sufficient for driving the flaps of the mixer valve according to the invention.

In another advantageous refinement of the invention, a movement of the flaps in both directions can be prevented in a simple manner if at least one of the control disks is biased into the main position by a spring element. In conjunction with the coupling of the drive pinions via the intermediate gearwheel, it is sufficient for only one of the control disks to be biased into the main position.

In another advantageous refinement of the invention, a further reduction of the outlay in terms of construction for the mixer valve is assisted if the spring element is in the form of a leg spring and is supported in a recess, which is arranged adjacent to the stops, of the housing.

In another advantageous refinement of the invention, the drive device is of particularly compact configuration if the exhaust duct and the intake duct are arranged at right angles to one another and if a single servomotor of the drive device is arranged in the corner region of the exhaust duct and of the intake duct.

In another advantageous refinement of the invention, the installation of the servomotor is particularly simple if the housing has a recess, which is accessible from the side of the stops, for the servomotor. Owing to this configuration, the control disks, the spring element and the drive pinions are accessible, together with the single servomotor, from one side. It is thus possible for the mixer valve according to the invention to be produced particularly inexpensively by mass production.

In another advantageous refinement of the invention, a further reduction of the dimensions of the mixer valve is assisted if the drive pinions are in the form of partial gearwheels with a ring of teeth extending over only 180°.

BRIEF DESCRIPTION OF THE DRAWINGS

The invention lends itself to numerous embodiments. To further illustrate its basic principle, one such embodiment is illustrated in the drawings and will be described below. In the drawings.

DETAILED DESCRIPTION OF THE PRESENTLY PREFERRED EMBODIMENTS

Figure 1:
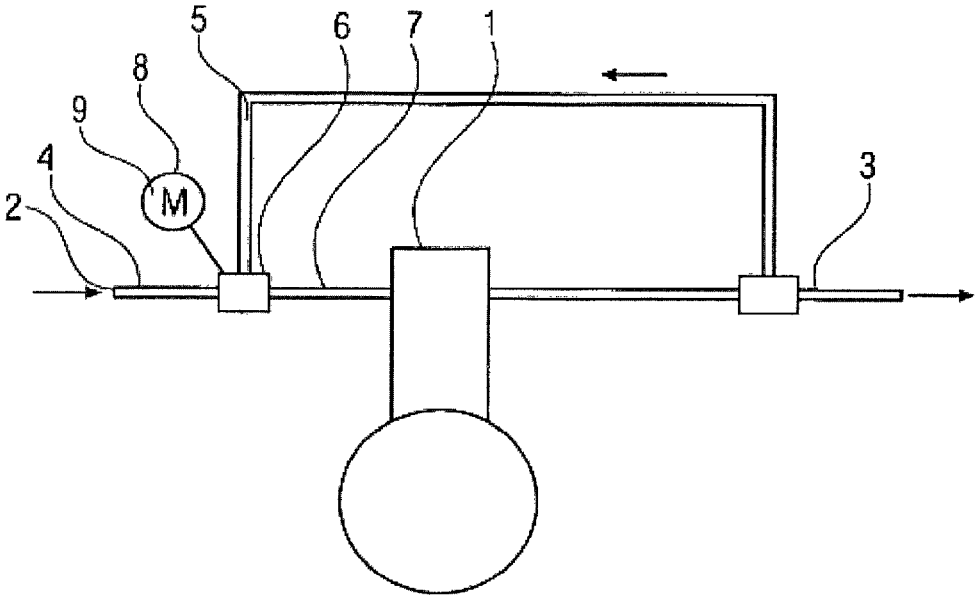
FIG. 1 schematically shows an internal combustion engine having a mixer valve according to the invention.

FIG. 1 schematically shows an internal combustion engine 1 having an intake line 2 and having an exhaust line 3. The intake line 2 has an intake duct 4 via which air is drawn in from the environment. From the exhaust line 3, an exhaust duct 5 leads via a mixer valve 6 into the intake line 2. The mixer valve 6 merges the intake duct 4 and the exhaust duct 5 to form a manifold duct 7. The manifold duct 7 leads directly to the internal combustion engine 1. A drive device 8 with an electric servomotor 9 permits an adjustment of the mixer valve 6.

Figure 2:
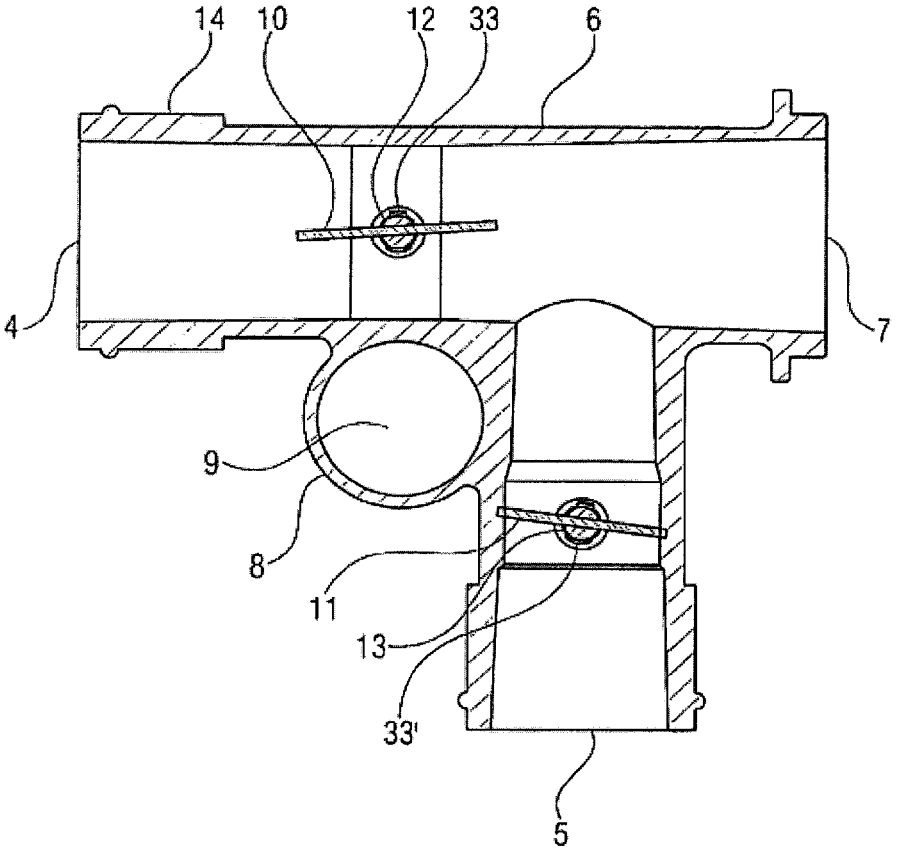
FIG. 2 shows a cross section through the mixer valve from FIG. 1.

FIG. 2 shows a sectional illustration of the mixer valve 6 from FIG. 1. In the intake duct 4 and in the exhaust duct 5, respective flaps 10 and 11 are fastened to pivotable shafts 12 and 13, respectively. The exhaust duct 5 is arranged at right angles to the intake duct 4. The servomotor 9 of the drive device 8 is arranged in the corner region between the intake duct 4 and exhaust duct 5. The shafts 12 and 13, and thus also the respective flaps 10 and 11, are driven by the servomotor 9.

Figure 3A:
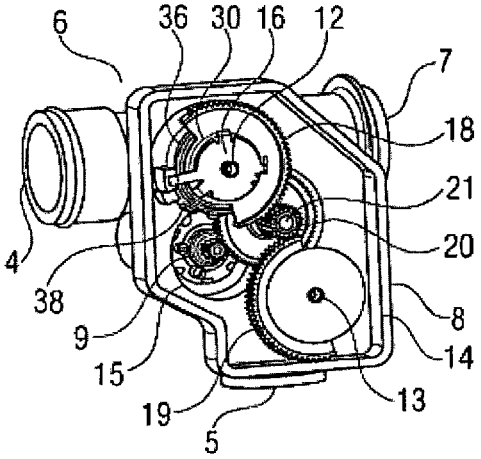
FIGS. 3A and 3B show the mixer valve in two perspective views of a drive device.
Figure 3B:
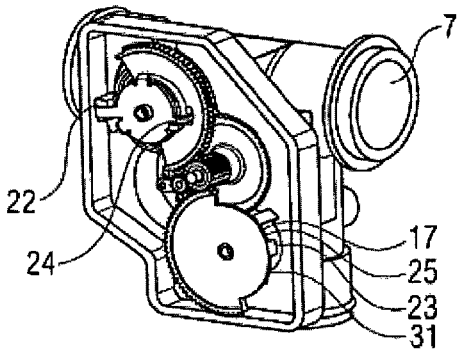

FIGS. 3A and 3B show the mixer valve 6 from two perspectives and in a plan view of the drive device 8. The mixer valve 6 has a housing 14 which is illustrated in an open state and which has a recess 15, open toward the plane of the drawing, for receiving the servomotor 9. Control disks 16 and 17 are arranged rotationally conjointly, and drive pinions 18 and 19 are mounted rotatably, on the respective shafts 12 and 13. The drive pinions 18 and 19 mesh with a common pinion 21. The servomotor 9 drives an intermediate gearwheel 20, which is connected to the pinion 21. The drive pinions 18 and 19 have, on their sides facing toward the control disks 16 and 17, a respective driver 22, 23 with which they project into a region of movement of a driver 24, 25 arranged on the control disks 16 and 17, respectively. Spring elements 30 and 31 bias the control disks 16 and 17, respectively, into a main position in which the intake duct 4 is open and the exhaust duct 5 is closed.

Figure 4:
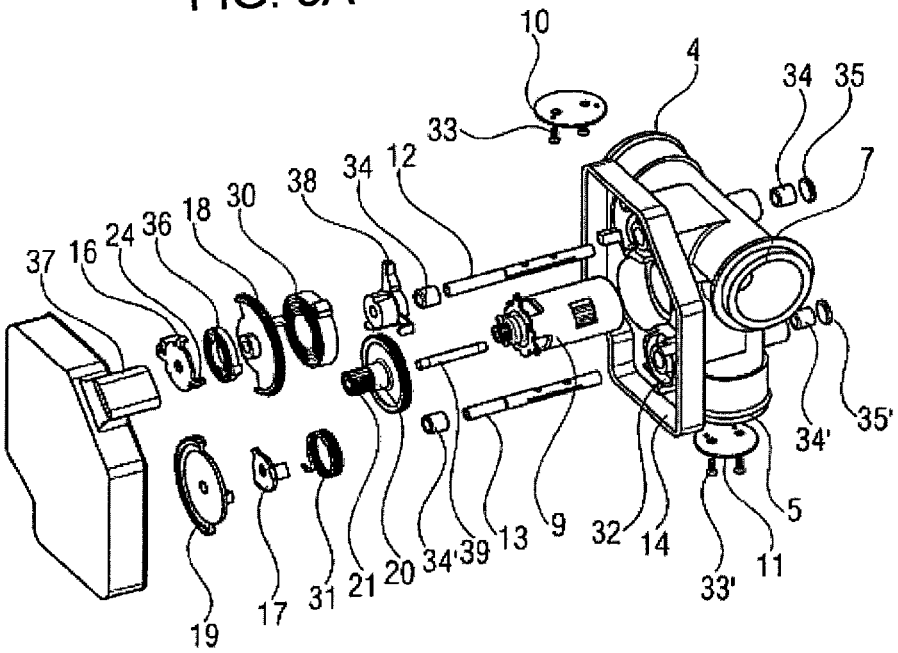
FIG. 4 shows the individual components of the mixer valve in an exploded illustration.

For illustrative purposes, FIG. 4 shows the individual components of the drive device in an exploded illustration. The flaps 10 and 11 are fastened to the shafts 12 and 13, respectively, by screws 33 and 33'. The shafts 12 and 13 have respective bearing bushings 34 and 34', and associated respective end portions 35 and 35', for mounting in the housing 14. A cap 37 closes off the housing 14 when in the installed state. The driver 24, arranged on the shaft 12 of the flap 10 of the intake duct 4, is connected by way of a further spring element 36 to the drive pinion 18. A second driver 38, fastened to the shaft 12, interacts with stops 26 and 27 illustrated in FIG. 5, of the housing. A structural unit composed of intermediate gearwheel 20 and pinion 21 is arranged rotatably on a bearing spindle 39 fastened in the housing 14.

Figure 5:
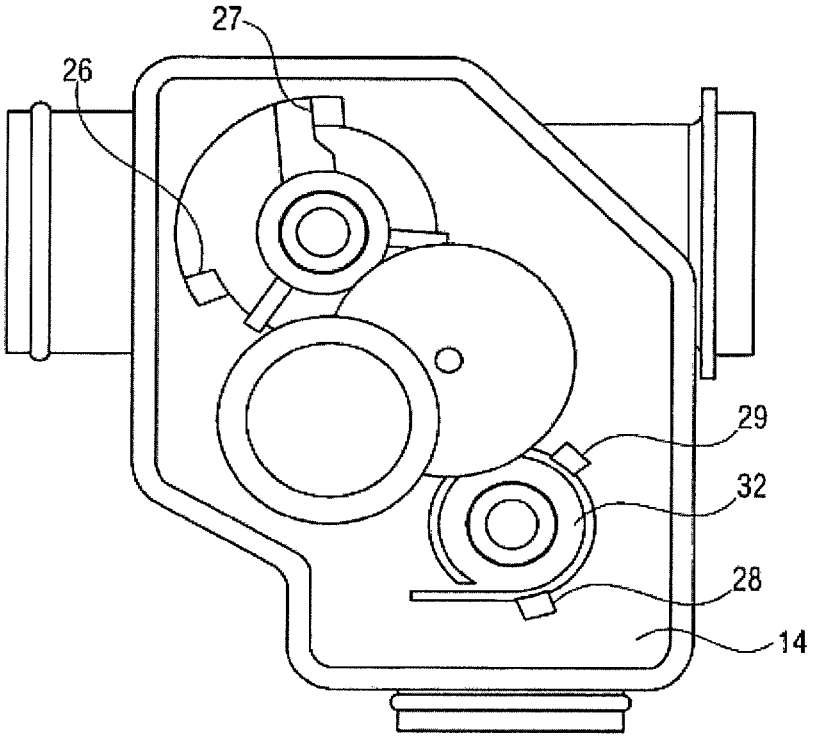
FIG. 5 shows a plan view of a housing of the mixer valve.

FIG. 5 shows a plan view of the housing 14. It can be seen in FIG. 5 that the housing 14 has stops 26-29 for supporting the respective drivers 24 and 25 of the control disks 16 and 17. Adjacent to the stops 28 and 29 for supporting the driver 25 of the control disk 17 of the flap 11 of the exhaust duct 5, the housing 14 has a recess 32 for supporting the spring element 31.

The two drive pinions 18 and 19 are driven by virtue of the drive device 8 being driven by the servomotor 9. In the process, initially, the control disk 17, fastened to the flap 11 of the exhaust duct 5, is driven along by the drive pinion 19 until the flap 11 of the exhaust duct 5 has been moved into the fully open position. In the process, the driver 22 of the other drive pinion 18 moves against the driver 24 of the control disk 16 of the flap 10 arranged in the intake duct 4. If the drive device 8 is driven further, the flap 10 in the intake duct 4 is closed.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A mixer valve (6) of an internal combustion engine (1) of a motor vehicle, the mixer valve (6) comprising:

an intake duct (4);

an exhaust duct (5);

a common manifold duct (7) into which each of the intake duct (4) and the exhaust duct (5) issue;

a first flap (10), having a first rotatable shaft (12) holding the first flap (10), arranged in the intake duct (4);

a second flap (11), having a second rotatable shaft (13) holding the second flap (11), arranged in the exhaust duct (5); and a drive device (8) configured to drive the first and second flaps (10, 11), the drive device (8) having:

first and second control disks (16, 17) respectively arranged rotationally conjointly on the first and second rotatable shafts (12, 13) of the first and second flaps (10, 11), and first and second drive pinions (18, 19) respectively mounted rotatably, and driven, on the first and second rotatable shafts (12, 13) of the first and second flaps (10, 11), wherein the control disks (16, 17) and the drive pinions (18, 19) have drivers (22-25) that correspond with one another, wherein the first control disk (16) is arranged axially outward of the first drive pinion (18) on the first rotatable shaft (12) and the second control disk (17) is arranged axially inward of the second drive pinion (19) on the second rotatable shaft (13), wherein the first and second drive pinions (18, 19) each comprise partial gearwheels with a ring of teeth extending over only 180°, and wherein the ring of teeth of first drive pinion (18) couple with the ring of teeth of the second drive pinion (19) via an intermediate common pinion gear (21).

2. The mixer valve as claimed in claim 1, further comprising a housing (14) configured to mount the first and second rotatable shafts (12, 13), the housing having stops (26-29) configured to support the drivers (24, 25).

3. The mixer valve as claimed in claim 1, wherein a least one of the first and second control disks (16, 17) is biased into a main position by a spring element (30, 31).

4. The mixer valve as claimed in claim 3, wherein the spring element (31) is supported in a recess (32), arranged adjacent to the stops (28, 29) of the housing (14).

5. The mixer valve as claimed in claim 3, wherein the exhaust duct (5) and the intake duct (4) are arranged at right angles to one another and a single servomotor (9) of the drive device (8) is arranged in a corner region of the exhaust duct (5) and of the intake duct (4).

6. The mixer valve as claimed in claim 2, wherein the housing (14) has a recess (15), accessible from the side of the stops (26-29), for the servomotor (9).

* * * * *